US005701920A

United States Patent [19]

Taylor et al.

[11] Patent Number: 5,701,920

[45] Date of Patent: Dec. 30, 1997

[54] DEBRAIDING TOOL

[76] Inventors: Joseph Taylor, 700 W. Laurel, Apt. A213, Compton, Calif. 90220; Brenda M. Taylor, 21 Albani Pl., Long Beach, Calif. 90802

[21] Appl. No.: 561,805

[22] Filed: Nov. 22, 1995

[51] Int. Cl.[6] ..... A45D 7/02

[52] U.S. Cl. ..... 132/212; 132/149; 132/125; 132/213.1; 132/150

[58] Field of Search ..... 132/212, 149, 132/213.1, 213, 207, 138, 120, 125, 150, 145, 124

[56] References Cited

U.S. PATENT DOCUMENTS

| | | | |
|---|---|---|---|
| 3,042,048 | 7/1962 | Mostik | 132/149 |
| 3,792,707 | 2/1974 | Tupper | 132/150 |
| 4,026,307 | 5/1977 | Morrow | 132/148 |
| 5,059,050 | 10/1991 | Guglielmo | 132/112 |
| 5,503,109 | 4/1996 | Sporn | 132/150 |

FOREIGN PATENT DOCUMENTS

| | | | |
|---|---|---|---|
| 2221840 | 2/1990 | United Kingdom | 132/213.1 |

*Primary Examiner*—Gene Mancene
*Assistant Examiner*—Pedro Philogene
*Attorney, Agent, or Firm*—Benman & Collins

[57] ABSTRACT

A braid-removing tool. The inventive tool comprises an elongate body portion having a longitudinal axis, a first end and a second end and being adapted for retention by a human hand. An elongate tooth is mounted at the first end of the body portion along an axis which is aparallel with respect to the longitudinal axis. In a specific embodiment, the inventive tool further comprises a hook mounted at the second end of the body portion. A finger grip is molded into a first side of the body portion and left and right thumb grooves are molded into a second side of the body portion. The tool allows a user to rapidly and safely remove braids with a simple turn of the wrist.

6 Claims, 2 Drawing Sheets

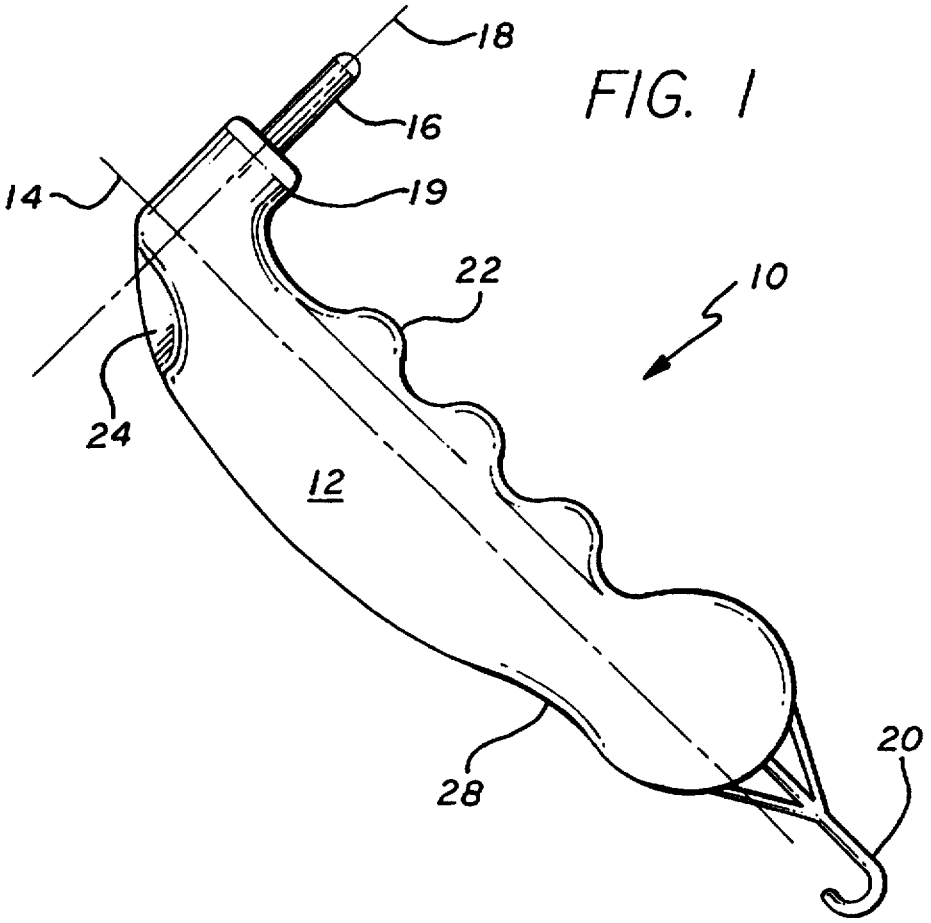
FIG. 1
FIG. 2
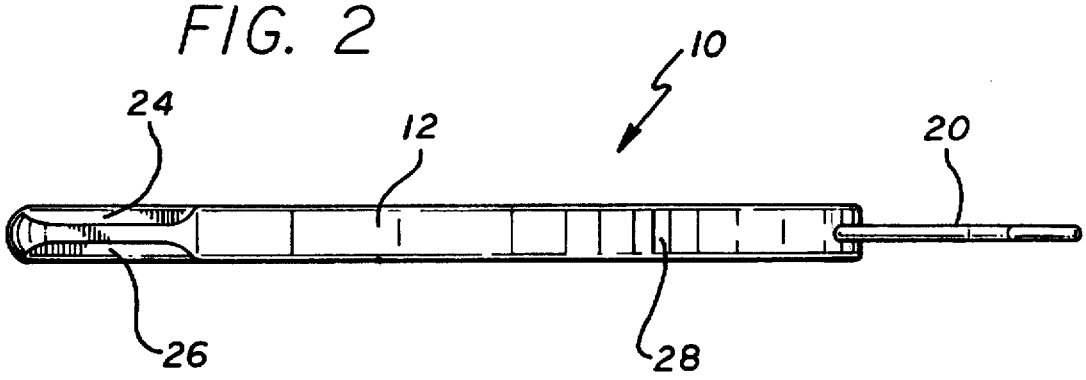

DEBRAIDING TOOL

BACKGROUND OF THE INVENTION

1. Field of the Invention

The present invention relates to tools and devices used to remove braids from hair, rope and other strands of weaved material. More specifically, the present invention relates to tools for removing braids by hand.

2. Description of the Related Art

The practice of braiding the hair for ornamental effect is centuries old and remains somewhat popular today. For French braids and corn rows, the hair is braided into 500–1000 tight, microthin braids. While the multiplicity of microthin braids typically creates the desired effect, they are somewhat problematic when the time comes for removal.

Currently, the removal of such braids is accomplished with the use of kitchen forks, scissors and other such devices. These conventional techniques are quite slow. For example, it typically requires three days to remove 500 to 1000 braids. Hence, the process is generally time-consuming and consequently expensive.

In addition, the use of the above-described conventional braid removal tools often damages the hair and causes muscle cramps in the hand of the user.

Hence, there is a need in the art for an inexpensive device which is effective as a tool for a safe, fast manual removal of braids, particularly, microthin braids.

SUMMARY OF THE INVENTION

The need in the art is addressed by the braid-removing tool of the present invention. The inventive tool comprises an elongate body portion having a longitudinal axis, a first end and a second end and being adapted for retention by a human hand. An elongate tooth is mounted at the first end of the body portion along an axis which is aparallel with respect to the longitudinal axis.

In a specific embodiment, the inventive tool further comprises a hook mounted at the second end of the body portion. A finger grip is molded into a first side of the body portion and left and right thumb grooves are molded into a second side of the body portion.

The tool allows a user to rapidly and safely remove braids with a simple turn of the wrist.

BRIEF DESCRIPTION OF THE DRAWINGS

FIG. 1 is a top view of the braid removing tool of the present invention.

FIG. 2 is a front view of the tool of the present invention.

DESCRIPTION OF THE INVENTION

Figure 3:
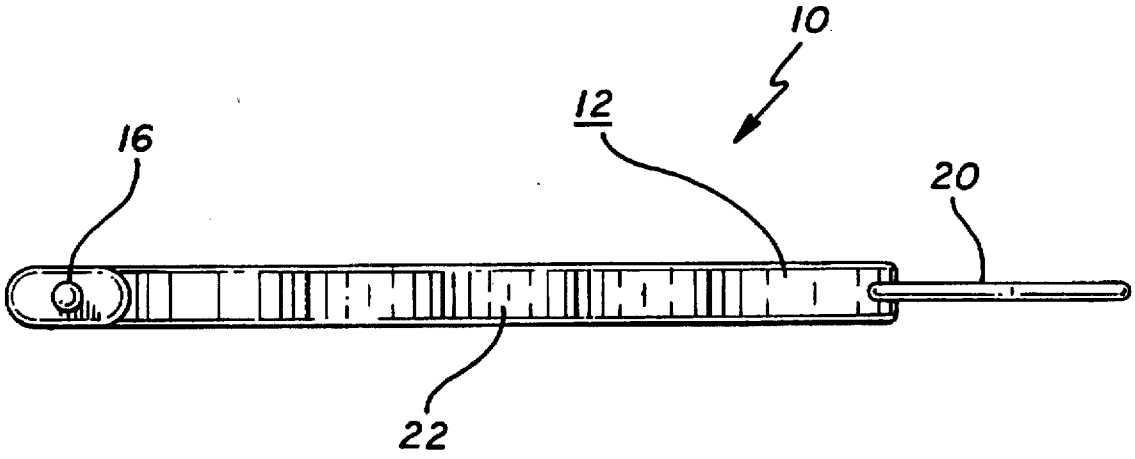
FIG. 3 is a back side view of the braid removing tool of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

FIG. 1 is a top view of the braid removing tool of the present invention. The tool 10 may be constructed of plastic, wood or other suitably rigid material. The tool 10 is sized to fit comfortably within a human hand. As shown in FIG. 1, the inventive tool 10 comprises an elongate body portion 12 having a longitudinal axis 14 therethrough. At a first end of the body portion 12, a short, yet elongate tooth 16 is mounted along an axis 18 which is aparallel with respect to the longitudinal axis 14. The tooth 16 may be constructed of the same material as the body portion. In the illustrative embodiment, the tooth 16 protrudes approximately one-half inch beyond the tip 19 of the body portion 12. The tooth 16 facilitates the removal of braids. The tooth 16 is inserted into the opening between the strands of the braid and with a simple twist of the wrist, the tooth 16 pulls the strands of hair apart and down from the head thereby disassembling the braid.

At a second end of the body portion 12 a hook 20 is mounted. The hook 20 may be constructed of the same material as the tooth 16 and may be used to facilitate the removal of stitching used to secure weaves of natural or artificial hair from the head. A finger grip 22 is molded into a first (back) side of the body portion 12.

FIG. 2 is a front view of the tool of the present invention. As depicted in FIG. 2, left and right thumb grooves 24 and 26 are molded into a second (front) side of the tool body 12.

As shown in FIGS. 1 and 2, a finger grip 28 is cut into the tool body 12 to accommodate a finger when in use.

FIG. 3 is a back side view of the braid removing tool of the present invention.

The tool allows a user to rapidly and safely remove braids with a simple turn of the wrist.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A braid removing tool comprising:

an elongate body portion having a longitudinal axis, a first end and a second end and being adapted for retention by a human hand and a single elongate tooth having a cross-sectional area adapted to engage an opening between strands in a braid, said tooth being mounted at the first end of the body portion along an axis which is aparallel with respect to the longitudinal axis.

2. The invention of claim 1 further including a hook mounted at the second end of the body portion and adapted to facilitate a removal of stitching used to secure weaves of hair from a head.

3. The invention of claim 1 further including a finger grip molded into a first side of the body portion.

4. The invention of claim 1 further including a first thumb groove molded into a second side of the body portion.

5. The invention of claim 4 further including a second thumb groove molded into the second side of the body portion.

6. A braid-removing tool comprising:

an elongate body portion having a longitudinal axis, a first end and a second end and being adapted for retention by a human hand;

a single elongate tooth having a cross-sectional area adapted to engage an opening between strands in a braid, said tooth being mounted at the first end of the body portion along an axis which is aparallel with respect to the longitudinal axis;

a hook mounted at the second end of the body portion and adapted to facilitate a removal of stitching used to secure weaves of hair from a head;

a finger grip molded into a first side of the body portion;

a first thumb groove molded into a second side of the body portion on a top surface thereof; and a second thumb groove molded into the second side of the body portion on a bottom surface thereof.

* * * * *